US006804853B2

(12) United States Patent
Wang

(10) Patent No.: US 6,804,853 B2
(45) Date of Patent: Oct. 19, 2004

(54) CLEANING DEVICE

(76) Inventor: Jack Kuang-Huei Wang, No. 27, Shu-Chung St., Shu-Lin City, Taipei Hsien (TW)

( * ) Notice: Subject to any disclaimer, the term of this patent is extended or adjusted under 35 U.S.C. 154(b) by 71 days.

(21) Appl. No.: 10/369,515

(22) Filed: Feb. 21, 2003

(65) Prior Publication Data

US 2004/0163194 A1 Aug. 26, 2004

(51) Int. Cl.[7] ..... A46B 7/02; A47L 13/12

(52) U.S. Cl. ..... 15/172; 15/105; 15/111; 15/117; 15/121; 15/201; 15/244.1; 15/245

(58) Field of Search ..... 15/105, 106, 111, 15/114, 117, 118, 121, 172, 201, 236.02, 244.1, 245

(56) References Cited

U.S. PATENT DOCUMENTS 3,564,638 A * 2/1971 Buchholtz ..... 15/201
4,908,900 A * 3/1990 McLaughlin et al. ..... 15/111
5,809,608 A * 9/1998 Zadro ..... 15/245

* cited by examiner

*Primary Examiner*—Mark Spisich
(74) *Attorney, Agent, or Firm*—Morgan Lewis & Bockius LLP

(57) ABSTRACT

A cleaning device includes a first cleaning member attached to a lower end of an elongated rod, and a second cleaning member mounted slidably on the first cleaning member. The second cleaning member is slidable in a transverse direction relative to the rod between an extended position, in which the second cleaning member is moved away from a free end of the first cleaning member, and a retracted position, in which the second cleaning member is moved toward the free end of the first cleaning member.

6 Claims, 8 Drawing Sheets

CLEANING DEVICE

BACKGROUND OF THE INVENTION

1. Field of the Invention

The present invention relates to a cleaning device, more particularly to a cleaning device with a first cleaning member and a second cleaning member that is extendible and retractable relative to the first cleaning member.

2. Description of the Related Art

A conventional cleaning device generally includes an elongated rod, and a cleaning member fixed to a lower mounting end of the elongated rod for cleansing floor.

One disadvantage of the conventional cleaning device resides in that the length of the cleaning member is unadjustable, thereby limiting the usage range.

SUMMARY OF THE INVENTION

Therefore, the object of this invention is to provide a cleaning device with adjustable cleaning members so as to overcome the aforesaid disadvantage of the prior art.

According to the present invention, a cleaning device includes: an elongated rod having a lower mounting end; a cleaning member connected to the mounting end of the elongated rod and extending in a transverse direction relative to the elongated rod, the cleaning member having a free end distal from the lower mounting end of the elongated rod; a cleaning unit mounted slidably on the cleaning member and slidable in the transverse direction between an extended position, in which the cleaning unit is moved away from the free end of the cleaning member, and a retracted position, in which the cleaning unit is moved toward the free end of the cleaning member; an adjustment unit including a runner sleeved slidably on the elongated rod and slidable along the elongated rod toward and away from the lower mounting end of the elongated rod between first and second positions, and a connecting member having two opposite ends pivoted respectively to the cleaning unit and the runner in such a manner that movement of the runner to the first position results in movement of the cleaning unit to the extended position and that movement of the runner to the second position results in movement of the cleaning unit to the retracted position; and a retaining member for retaining the runner at the first position.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENTS

Figure 1:
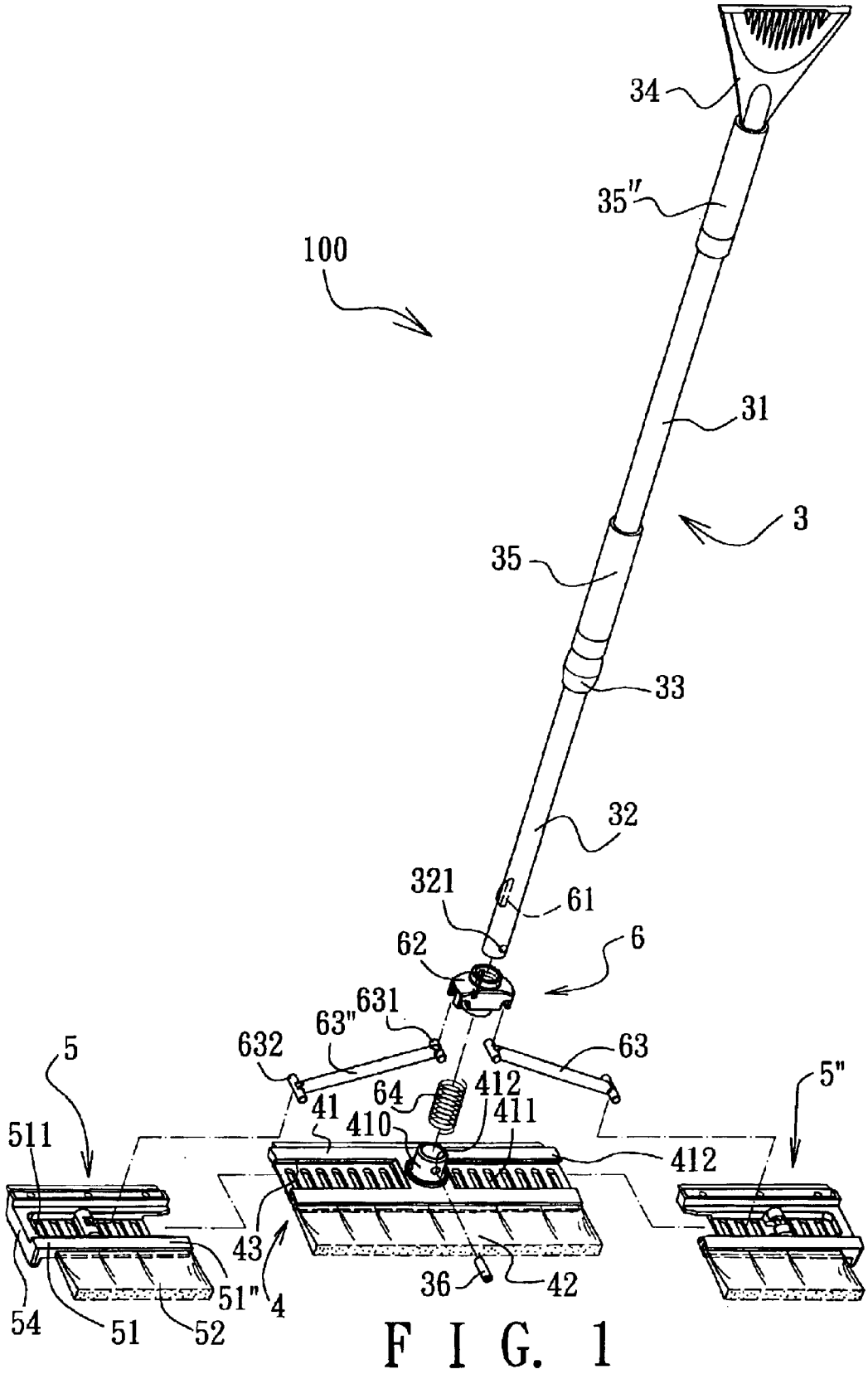
FIG. 1 is an exploded perspective view of the first preferred embodiment of a cleaning device according to the present invention.
Figure 2:
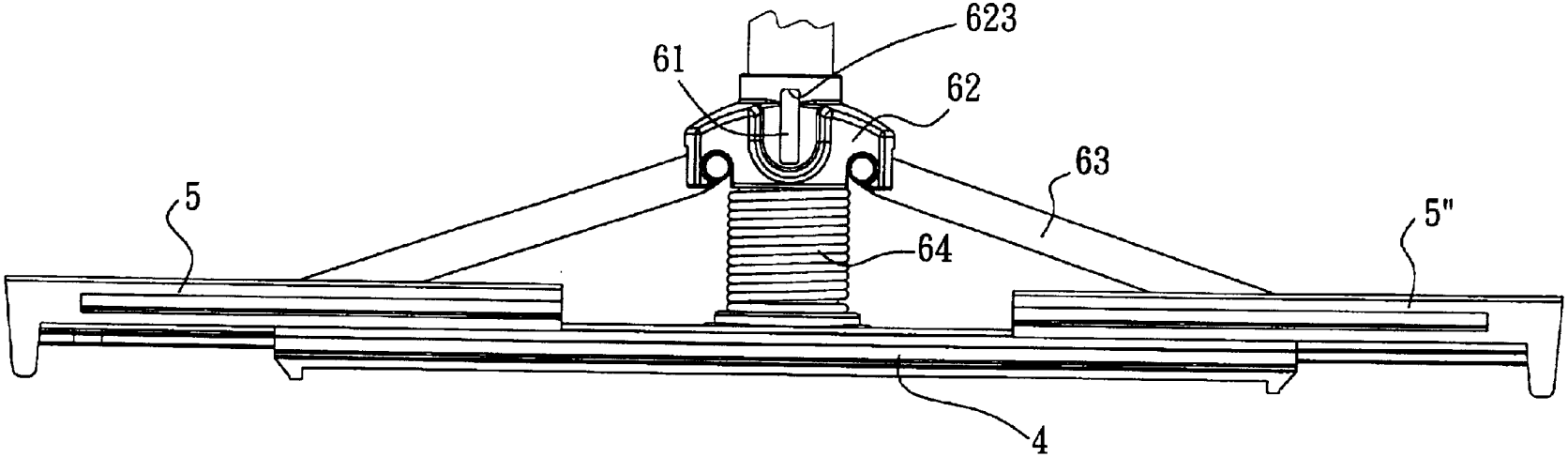
FIG. 2 is a schematic front view of the first preferred embodiment, illustrating how two second cleaning members are moved away from a first cleaning member due to movement of a runner on an elongated rod to a first position.
Figure 3:
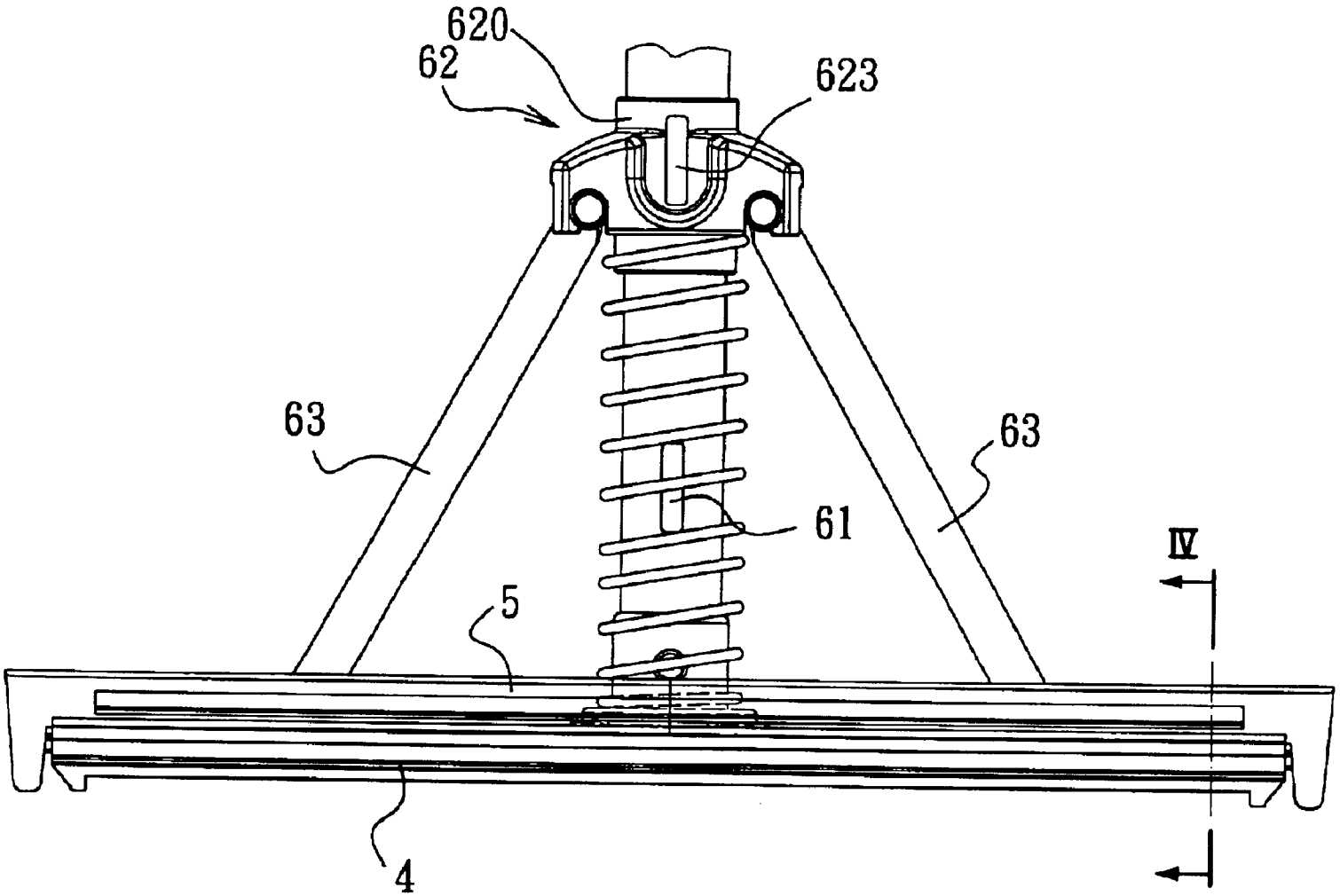
FIG. 3 is a schematic front view of the first preferred embodiment, illustrating how the second cleaning members are moved toward the first cleaning member due to movement of the runner on the elongated rod to a second position.

Referring to FIGS. 1 to 3, the first preferred embodiment of a cleaning device 100 according to the present invention is shown to include an elongated rod 3, a first cleaning member 4, a cleaning unit 5", an adjustment unit 6, and a retaining member.

The elongated rod 3 includes a hollow lower rod portion 32, and a hollow upper rod portion 31 that is telescopically connected to the lower rod portion 32 through an adjusting sleeve 33. An anti-slip sheath 35 is mounted on the adjusting sleeve 33 to facilitate gripping of the elongated rod 3. A snow shovel 34 is fixed to an upper mounting end of the upper rod portion 31 through another adjusting sleeve 35".

The first cleaning member 4 is connected to a lower mounting end 321 of the lower rod portion 32, and extends in a transverse direction relative to the elongated rod 3. The first cleaning member 4 has a free end 412 that is distal from the lower mounting end 321 of the lower rod portion 32.

The cleaning unit 5" is mounted slidably on the first cleaning member 4, and is slidable in the transverse direction between an extended position, in which the cleaning unit 5" is moved away from the free end 412 of the first cleaning member 4, as best shown in FIG. 2, and a retracted position, in which the cleaning unit 5" is moved toward the free end 412 of the first cleaning member 4, as best shown in FIG. 3. The adjustment unit 6 includes a runner 62 and a connecting member 63. The runner 62 is sleeved slidably on the lower rod portion 32, and is slidable therealong toward and away from the lower mounting end 321 of the lower rod portion 32 between first and second positions, as best shown in FIGS. 2 and 3, respectively. The connecting member 63 has two opposite ends 631, 632 pivoted respectively to the cleaning unit 5" and the runner 62 in such a manner that movement of the runner 62 to the first position results in movement of the cleaning unit 5" to the extended position and that movement of the runner 62 to the second position results in movement of the cleaning unit 5" to the retracted position.

The retaining member retains the runner 62 at the first position.

Figure 4:
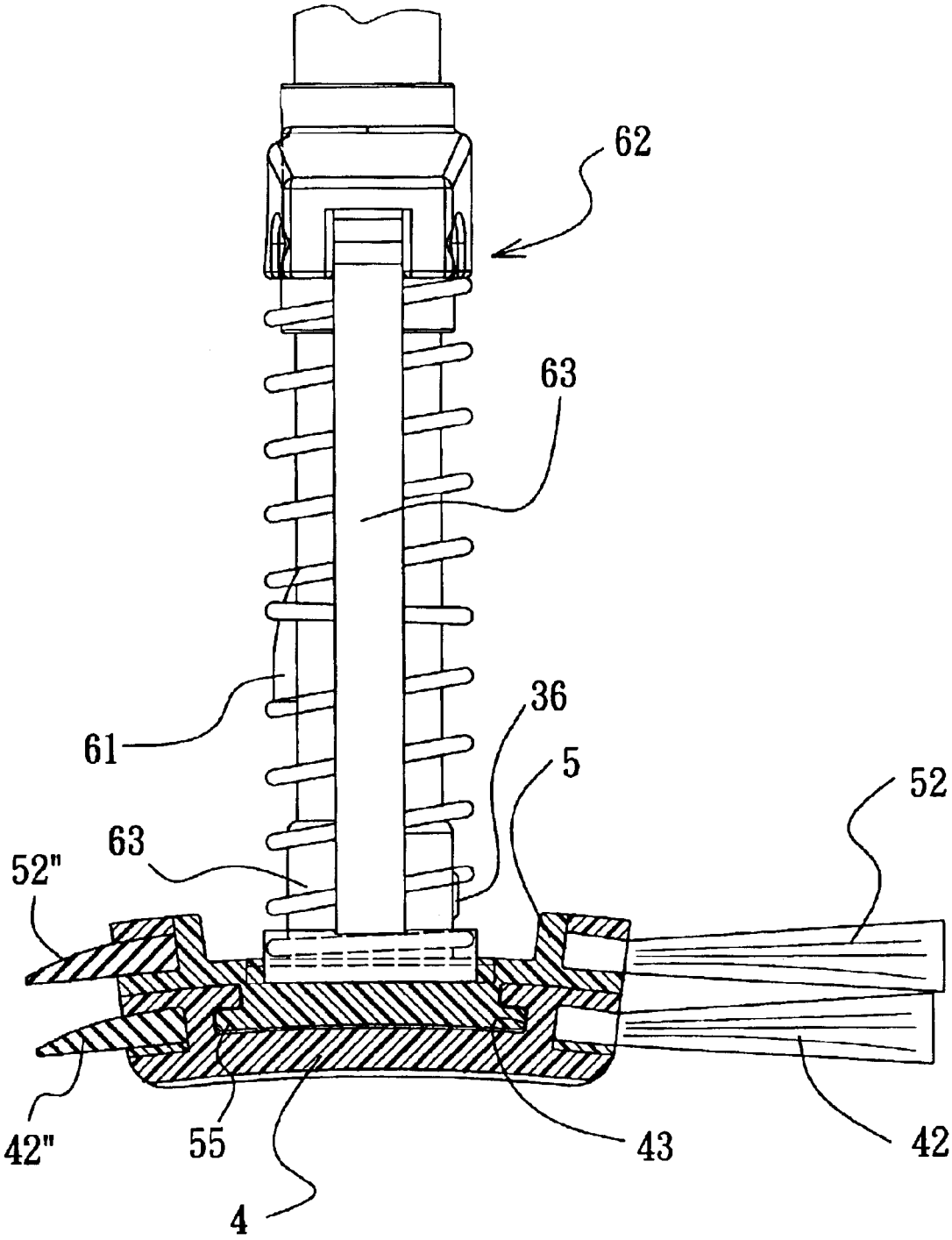
FIG. 4 is a fragmentary sectional view of the first preferred embodiment taken along lines IV—IV in FIG. 2 when the runner is moved to the second position on the elongated rod.
Figure 6:
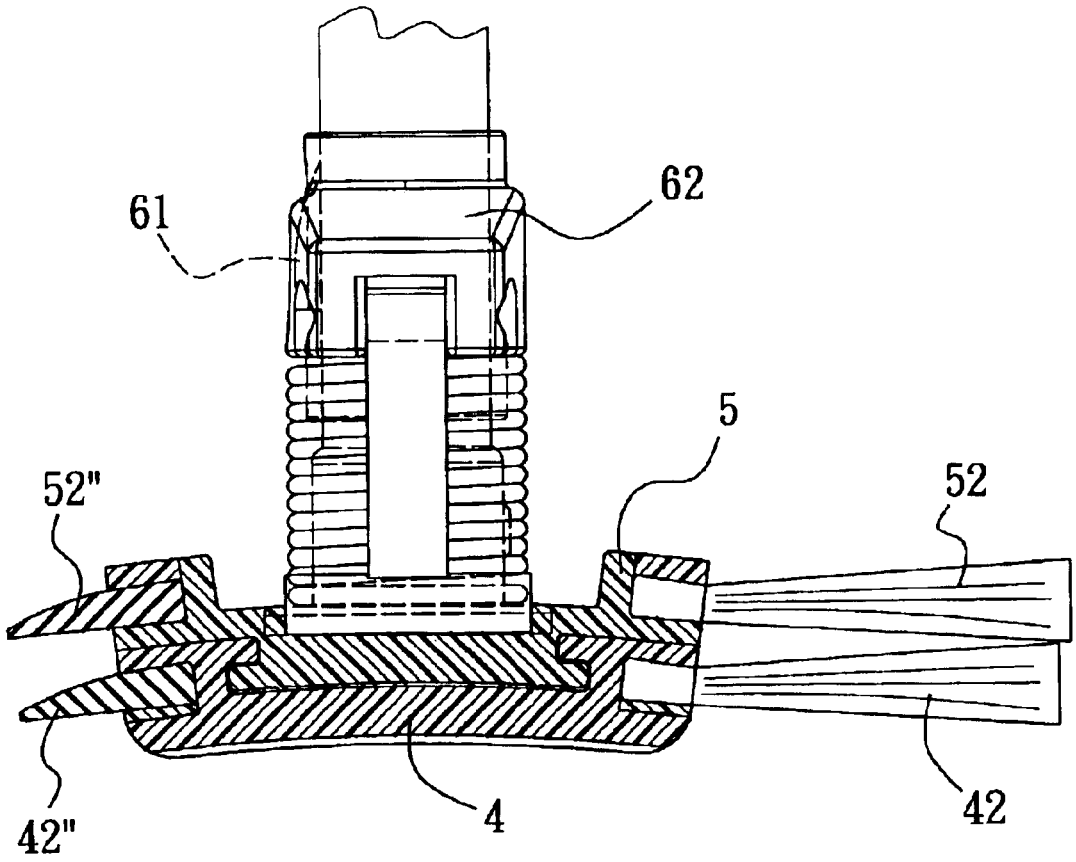
FIG. 6 is a fragmentary sectional side view of the first preferred embodiment when the runner is moved to the first position on the elongated rod.

In this preferred embodiment, the first cleaning member 4 includes two parallel mounting bars 41 extending in the transverse direction and formed with a pair of sliding grooves 43 therebetween. A pivot seat 410 is disposed midway of the sliding grooves 43 in the first cleaning member 4, and projects upwardly therefrom to connect pivotally the lower mounting end 321 of the lower rod portion 32 through a pivot pin 36. Two cleansing articles 42 (42"), such as a sponge and an elongated rubber scrub, are fixed respectively to and project oppositely and outwardly from the mounting bars 41 of the first cleaning member 4. The cleaning unit 5" preferably includes opposing left and right second cleaning members 51 which are disposed at two opposite sides of the pivot seat 410 and each of which is formed with two wings 55 (see FIG. 4) that are slidably received in the respective sliding grooves 43. Each of the second cleaning members 51 is provided with two cleansing articles 52 (52") similar to that of the first cleaning member 4. When at the retracted position, the cleansing articles 52 (52") of the second cleaning members 51 are disposed above the cleansing articles 42 (42") of the first cleaning member 4, as shown in FIG. 6.

Figure 5:
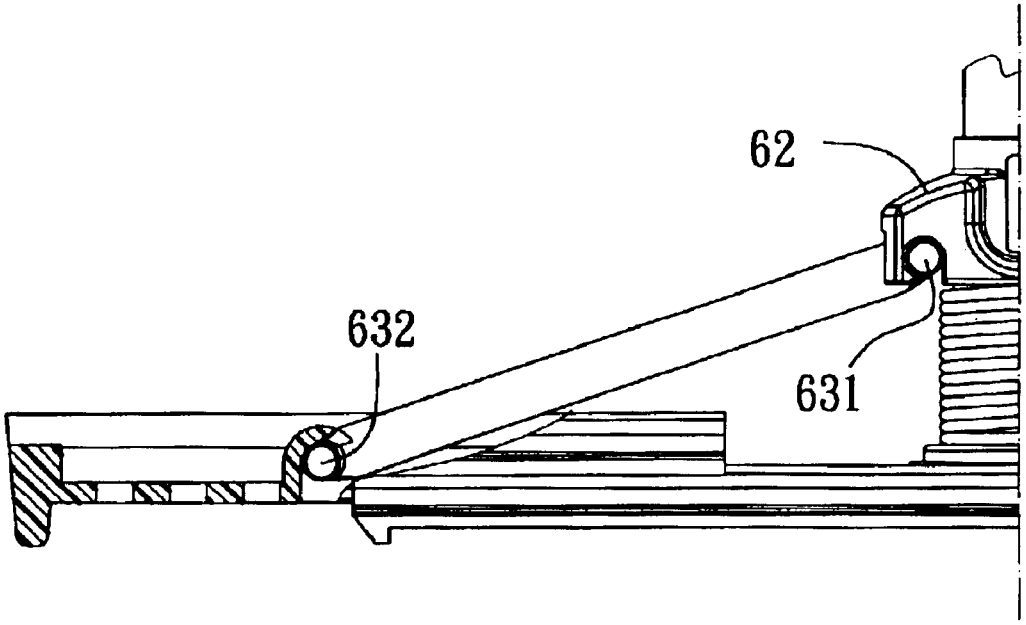
FIG. 5 is a fragmentary sectional front view of the first preferred embodiment, illustrating how the second cleaning members are connected to the first cleaning member when the runner is moved to the first position on the elongated rod.

The connecting member 63" includes two connecting rods 63. The two opposite ends 631, 632 of each of the connecting rods 63 are pivoted respectively to a respective one of the second cleaning members 51 and the runner 62, as best shown in FIG. 5.

The runner 62 is preferably in the form of a tubular sleeve 620 (see FIG. 3) that is slidably sleeved on the lower rod portion 32 and that is formed with an engaging hole 623. The retaining member of the present invention includes an urging member 64 sleeved on the lower rod portion 32 to urge the tubular sleeve 620 to the second position, and a spring-biased tongue 61 that is mounted movably on the lower rod portion 32 and that extends into the engaging hole 623 in the tubular sleeve 620 when the runner 62 is moved to the first position so as to retain the tubular sleeve 620 at the first position. The spring-biased tongue 61 is pressible to retract into the lower rod portion 32 so as to disengage from the engaging hole 623, thereby permitting movement of the runner 62 to the second position.

The first cleaning member 4 further includes a base plate 411 (see FIG. 1) that interconnects the mounting bars 41 and that is formed with a plurality of drain holes. In a similar manner, each of the second cleaning members 51 includes a pair of mounting bars 51" and a base plate 54 that interconnects the mounting bars 51" and that is formed with a plurality of drain holes 511. When disposed at the retracted position, the drain holes 511 in the second cleaning members 51 are aligned with the drain holes in the first cleaning member 4.

Figure 7:
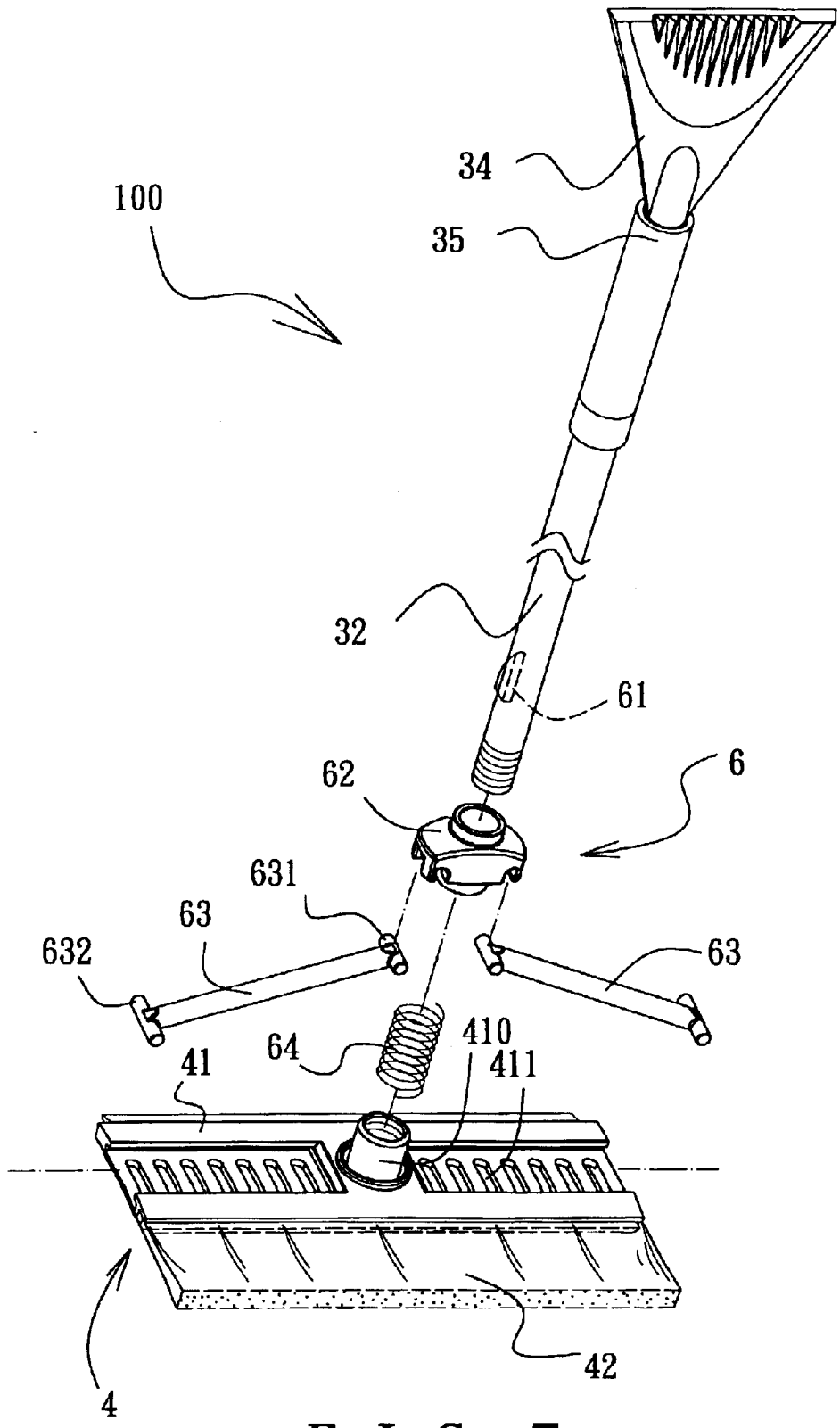
FIG. 7 is an exploded view of the second preferred embodiment with the second cleaning members removed therefrom.
Figure 8:
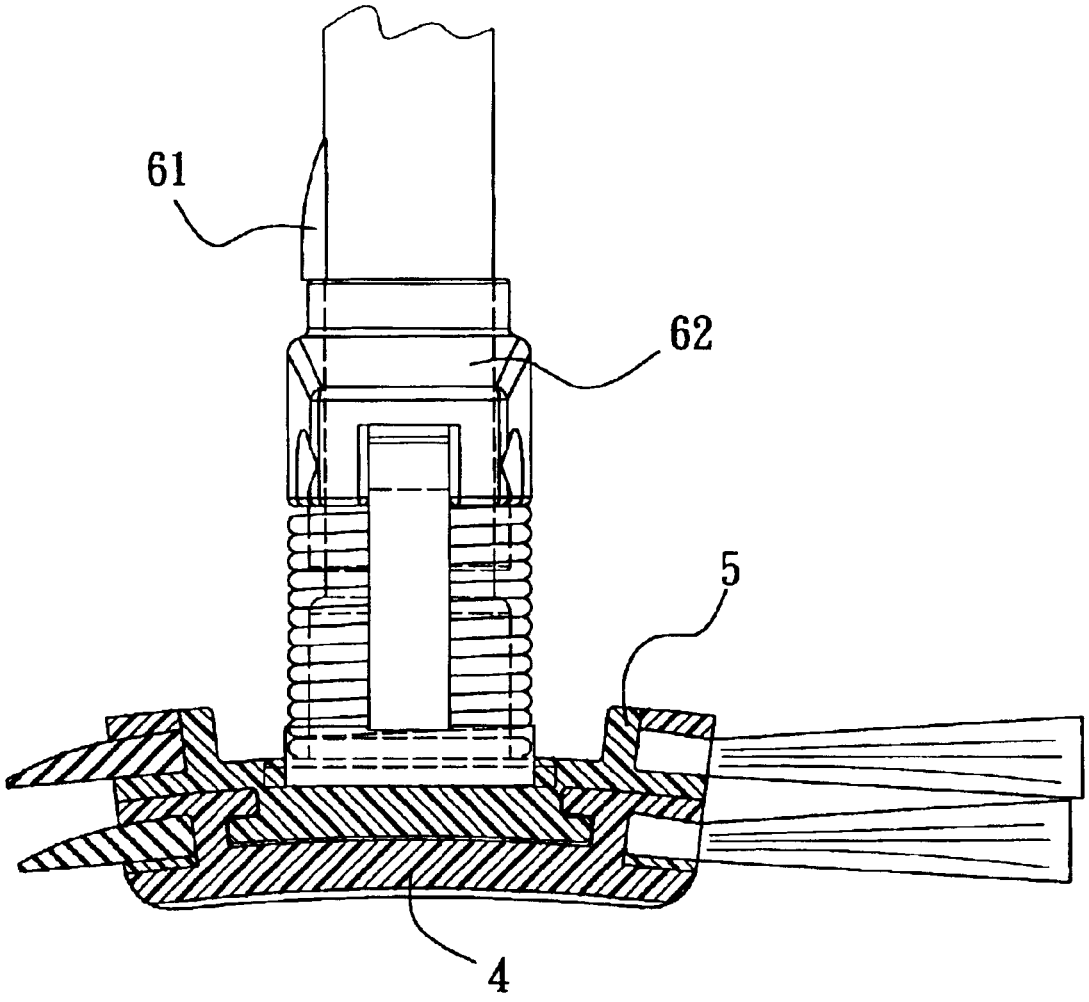
FIG. 8 is a fragmentary sectional side view of the second preferred embodiment when the runner is moved to the first position on the elongated rod.

Referring to FIGS. 7 and 8, the second preferred embodiment of a cleaning device according to the present invent is shown to have a construction similar to that of the previous embodiment. The main difference resides in that the pivot seat 410 of the first cleaning member 4 is threadedly fastened to the lower mounting end 321 of the lower rod portion 32.

With this invention thus explained, it is apparent that numerous modifications and variations can be made without departing from the scope and spirit of this invention. It is therefore intended that the invention be limited only as indicated in the appended claims.

I claim:

1. A cleaning device comprising:

an elongated rod having a lower mounting end;

a first cleaning member connected to said mounting end of said elongated rod and extending in a transverse direction relative to said elongated rod, said first cleaning member having a free end that is distal from said mounting end of said elongated rod;

a cleaning unit mounted slidably on said first cleaning member and slidable in said transverse direction between an extended position, in which said cleaning unit is moved away from said free end of said first cleaning member, and a retracted position, in which said cleaning unit is moved toward said free end of said first cleaning member;

an adjustment unit including a runner sleeved slidably on said elongated rod and slidable along said elongated rod toward and away from said lower mounting end of said elongated rod between first and second positions, and a connecting member having two opposite ends pivoted respectively to said cleaning unit and said runner in such a manner that movement of said runner to said first position results in movement of said cleaning unit to said extended position and that movement of said runner to said second position results in movement of said cleaning unit to said retracted position; and a retaining member for retaining said runner at said first position.

2. The cleaning device as defined in claim 1, wherein said first cleaning member includes two parallel mounting bars extending in said transverse direction and formed with a pair of sliding grooves therebetween, and a pivot seat that is disposed midway of said sliding grooves, and that projects upwardly therefrom to connect pivotally with said lower mounting end of said elongated rod, said cleaning unit including opposing second cleaning members disposed at two opposite sides of said pivot seat and formed with wings that are slidably and respectively received in said sliding grooves.

3. The cleaning device as defined in claim 2, wherein said connecting member includes two connecting rods, said two opposite ends of each of said connecting rods being pivoted respectively to a respective one of said second cleaning members and said runner.

4. The cleaning device as defined in claim 3, wherein said runner includes a tubular sleeve that is slidably sleeved on said elongated rod and that is formed with an engaging hole, said elongated rod having a hollow lower rod portion, said retaining member including an urging member sleeved on said lower rod portion of said elongated rod to urge said tubular sleeve to said second position, and a spring-biased tongue that is mounted on said lower rod portion of said elongated rod and that extends into said engaging hole in said tubular sleeve when said runner is moved to said first position so as to retain said tubular sleeve at said first position, said spring-biased tongue being pressible to retract into said lower rod portion of said elongated rod so as to disengage from said engaging hole, thereby permitting movement of said runner to said second position.

5. The cleaning device as defined in claim 4, wherein said elongated rod further has an upper rod portion that is telescopically connected to said lower rod portion.

6. The cleaning device as defined in claim 4, wherein said first cleaning member further includes a base plate interconnecting said mounting bars and formed with a plurality of drain holes.

* * * * *